US006763988B2

(12) United States Patent
Huang

(10) Patent No.: US 6,763,988 B2
(45) Date of Patent: Jul. 20, 2004

(54) MOVABLE AIR-PERMEABLE-TAPE DISPENSER

(76) Inventor: Mei Chih Huang, 2F, No. 45, Lane 232, Hu Lin St., Taipei (TW)

( * ) Notice: Subject to any disclaimer, the term of this patent is extended or adjusted under 35 U.S.C. 154(b) by 61 days.

(21) Appl. No.: 10/138,407

(22) Filed: May 6, 2002

(65) Prior Publication Data

US 2003/0205602 A1 Nov. 6, 2003

(51) Int. Cl.[7] ..... B26F 3/02

(52) U.S. Cl. ..... 225/43; 225/47; 225/89; 225/53; 225/56

(58) Field of Search ..... 225/39, 43, 53, 225/56, 89, 90, 20, 47

(56) References Cited

U.S. PATENT DOCUMENTS 1,151,971 A * 8/1915 Schulz ..... 225/47
1,246,830 A * 11/1917 Schulz ..... 225/43
2,031,033 A * 2/1936 Denebeim ..... 225/47
2,622,815 A * 12/1952 Waterman ..... 225/44
4,302,500 A * 11/1981 Flora ..... 442/381
4,447,482 A * 5/1984 Heinzelman et al. ..... 428/42.3
5,133,980 A * 7/1992 Ream et al. ..... 426/115
5,222,644 A * 6/1993 Moreno ..... 225/19
5,680,978 A * 10/1997 Pinion ..... 225/106
2003/0102347 A1 * 6/2003 Caviness ..... 225/43

* cited by examiner

*Primary Examiner*—Boyer D. Ashley
(74) *Attorney, Agent, or Firm*—Bacon & Thomas, PLLC

(57) ABSTRACT

A movable air-permeable-tape dispenser. The dispenser includes a hollow cylindrical body provided with an axial long opening. A slide channel is parallelly adjacent to a first longitudinal edge of the long opening, and a stepped portion is parallelly adjacent to a second longitudinal edge of the opening. A cover is provided with a row of continuous teeth corresponding to the second longitudinal edge of the long opening and a shaft corresponding to the first longitudinal edge of the long opening. The shaft is fitted in the slide channel to enable the cover to pivotally turn about the shaft between a lifted position for a user to pull out via the long opening a length of air-permeable tape disposed in the cylindrical body.

2 Claims, 5 Drawing Sheets

MOVABLE AIR-PERMEABLE-TAPE DISPENSER

BACKGROUND OF THE INVENTION

The present invention relates to a movable air-permeable-tape dispenser, and more particularly to an air-permeable-tape dispenser that is conveniently portable and can be easily operated to dispense any desired length of air-permeable tape for use.

A conventional movable air-permeable-tape dispenser usually includes a box having an openable flap. To use a roll of air-permeable tape positioned in the box, the flap is lifted to pull out a length of the tape via an opening of the box, and then tear the tape from the roll. The tape dispenser itself does not include any cutting means. To facilitate easy tear of the tape, the tape is provided with weakening lines at regular intervals. However, the provision of weakening lines increases the manufacturing cost of the tape and does not work effectively.

SUMMARY OF THE INVENTION

It is therefore a primary object of the present invention to provide a movable air-permeable-tape dispenser that can be easily operated to dispense any desired length of air-permeable tape for use.

Another object of the present invention is to provide a movable air-permeable-tape dispenser that includes cutting means for conveniently cutting off a length of outward pulled tape, so that spaced weakening lines may be omitted from the tape to reduce the manufacturing cost thereof.

To achieve the above and other objects, the movable air-permeable-tape dispenser of the present invention mainly includes a hollow cylindrical body provided with an axial long opening, a slide channel parallelly adjacent to a first longitudinal edge of the long opening, and a stepped portion parallelly adjacent to a second longitudinal edge of the long opening; and a cover provided with a row of continuous teeth corresponding to the second longitudinal edge of the long opening and a shaft corresponding to the first longitudinal edge of the long opening. The shaft on the cover is fitted in the slide channel on the cylindrical body to enable the cover to pivotally turn about the shaft between a lifted position for a user to pull out via the long opening a length of air-permeable tape disposed in the cylindrical body, and a closed position for the outward pulled tape to be cut off with the row of teeth on the cover.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
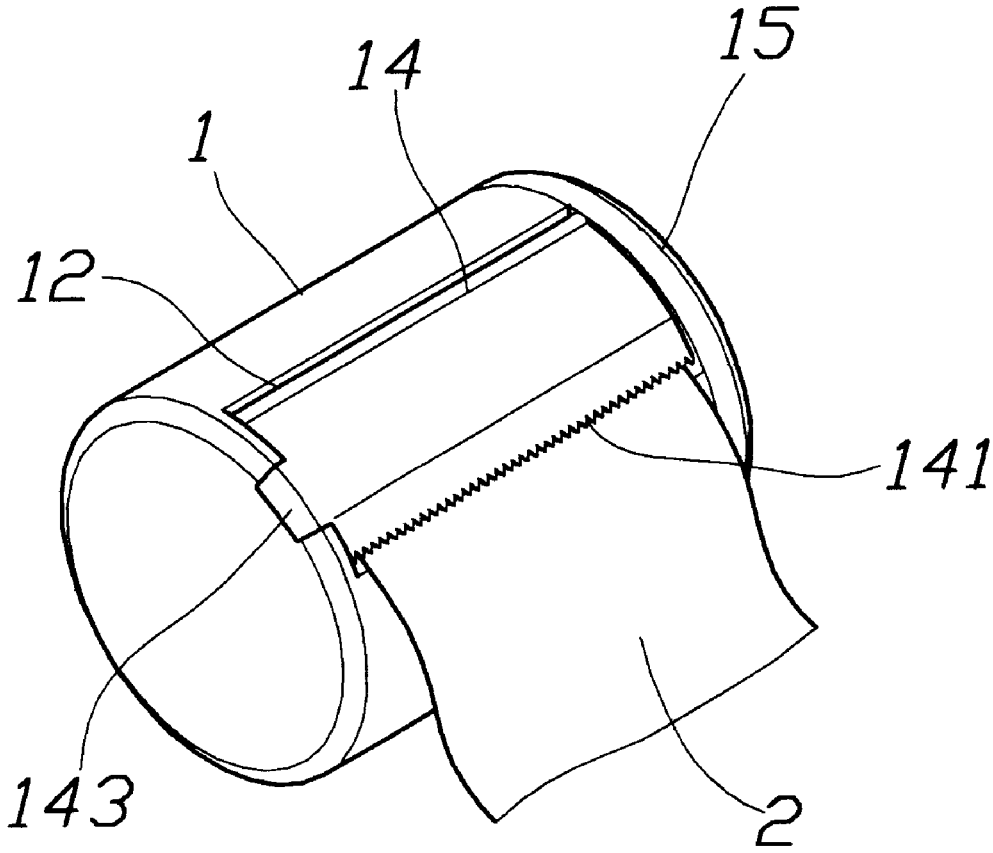
FIG. 1 is an assembled perspective view of a movable air-permeable-tape dispenser according to an embodiment of the present invention.
Figure 2:
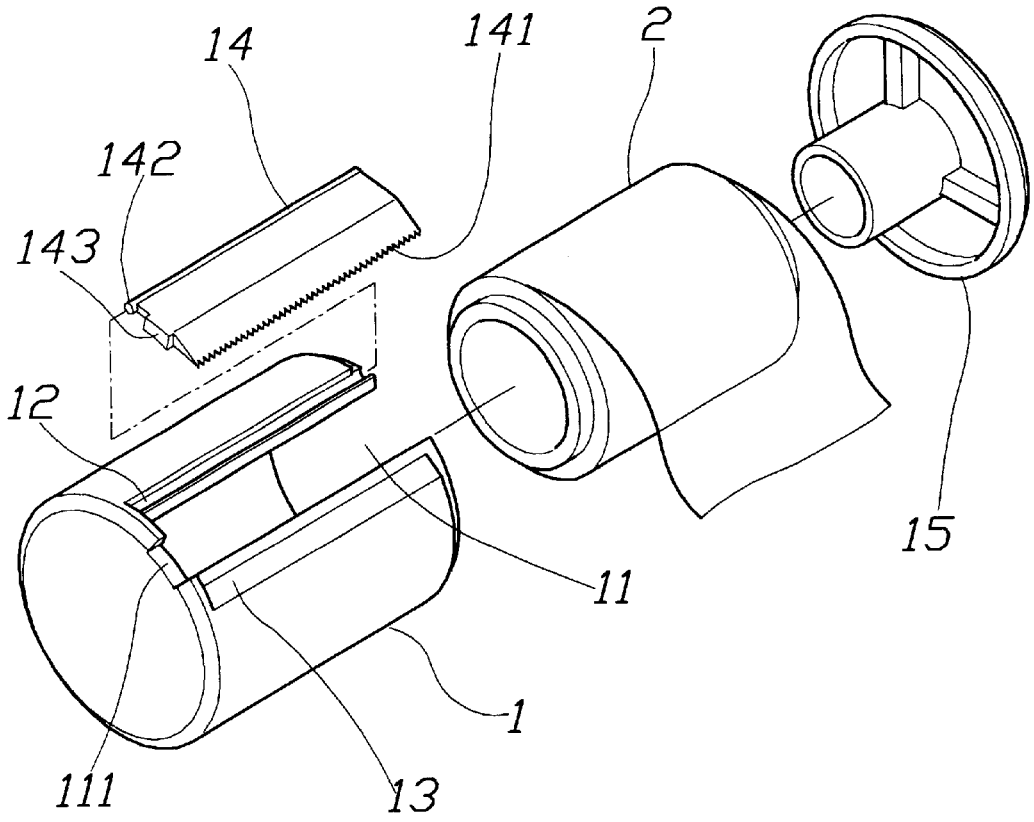
FIG. 2 is an exploded perspective view of FIG. 1.

Please refer to FIGS. 1 and 2 that are assembled and exploded perspective views, respectively, of a movable air-permeable-tape dispenser according to a first embodiment of the present invention. As shown, the present invention mainly includes a hollow cylindrical body 1 having an axially extended long opening 11 provided on a circumferential surface thereof. A slide channel 12 is formed on the cylindrical body 1 in parallel with and adjacent to a first longitudinal edge of the long opening 11, and a stepped portion 13 is formed in parallel with and adjacent to a second longitudinal edge of the long opening 11. The opening 11 is closed with a removable cover 14. An end of the cylindrical body 1 is formed of a removable cap 15. A roll of air-permeable tape 2 may be disposed into the cylindrical body 1 by removing and then replacing the cap 15.

The cover 14 has a curvature the same as that of the cylindrical body 1, and is provided at a front edge corresponding to the second longitudinal edge of the opening 11 with a row of continuous teeth 141 and at a rear edge corresponding to the first longitudinal edge of the opening 11 with a shaft 142. The shaft 142 is diametrically slightly smaller than the slide channel 12 on the cylindrical body 1 to be slid into and fitted in the slide channel 12, enabling the cover 14 to pivotally turn about the shaft 142 relative to the opening 11 between a lifted position, in which the opening 11 is opened and an end-of-beginning of the roll of air-permeable tape 2 disposed in the cylindrical body 1 may be pulled outward via the opening 11, and a closed position, in which the opening 11 is closed and the roll of air-permeable tape 2 having been outward pulled by a desired length can be cut off with the teeth 141 provided along the front edge of the cover 14. In this manner, the air-permeable tape 2 in the cylindrical body 1 can be conveniently dispensed for use.

The cylindrical body 1 is provided at a joint of the opening 11 and an end surface opposite to the removable cap 15 with a recess 111, which has a circumferential length smaller than a distance between the first and the second longitudinal edges of the opening 11, and the cover 14 is formed at a transverse end corresponding to the recess 111 with an axial protrusion 143. When the cover 14 is turned to the closed position, the protrusion 143 is fitly located in the recess 111, and the row of teeth 141 is flatly located in the stepped portion 13 parallelly adjacent to the second longitudinal edge of the opening 11 to bear against the end-of-beginning of the air-permeable tape 2. These arrangements allow the cover 14 to tightly close the opening 11 to facilitate easy cut-off of the air-permeable tape 2 and prevent dust from entering into the cylindrical body 1.

Figure 3:
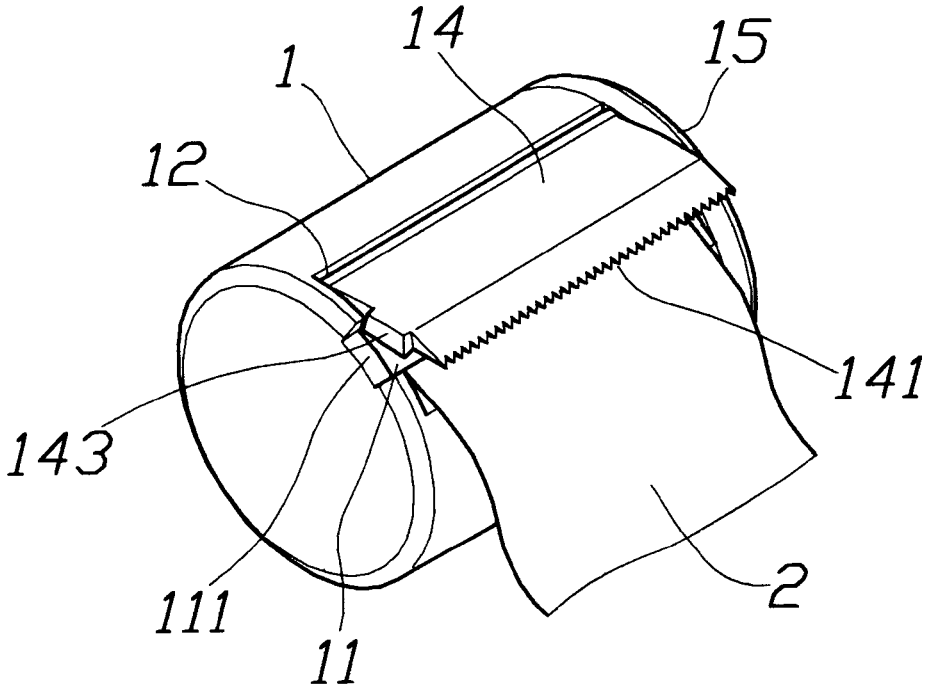
FIG. 3 is a perspective view showing the use of the present invention.
Figure 4:
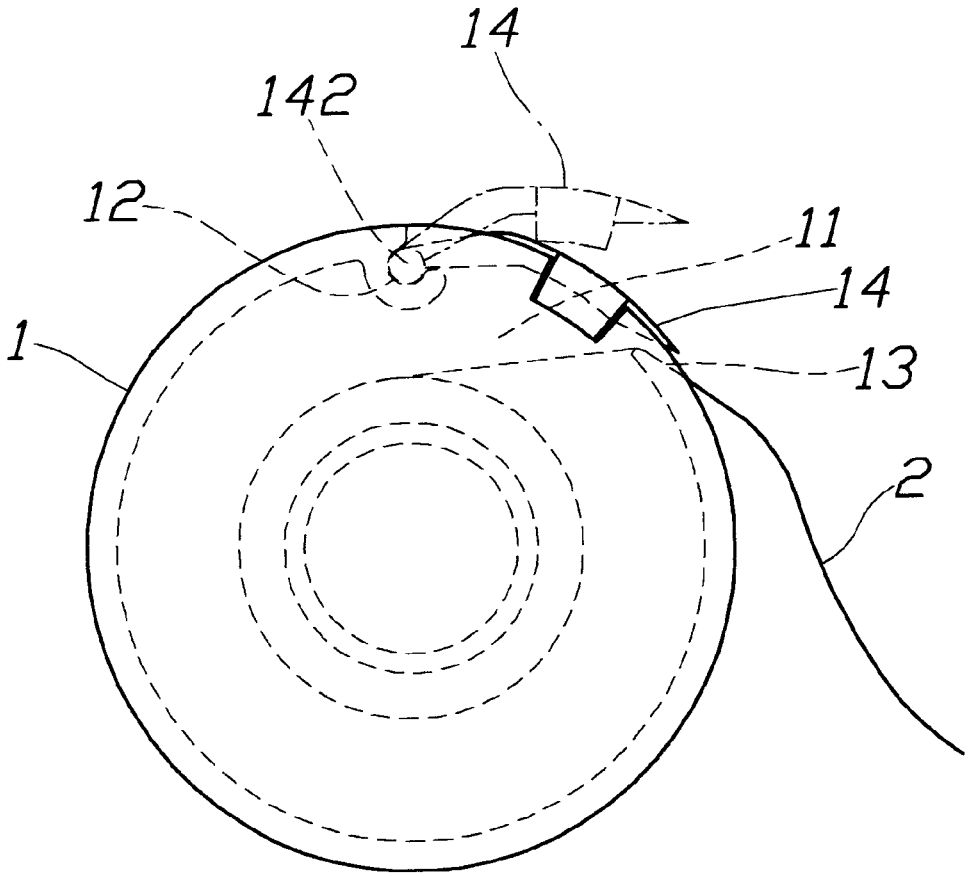
FIG. 4 is a side view of FIG. 3.

Please refer to FIGS. 3 and 4 at the same time. To use the movable air-permeable-tape dispenser of the present invention, first lift the cover 14 to separate it from the end-of-beginning of the tape 2. A user may then pull the tape 2 outward via the opening 11 to expose a desired length of the tape 2. The cover 14 is then closed again to bear against the tape 2 above the stepped portion 13, and the user may tear the tape 2 along the row of teeth 141 on the cover 14 to obtain a length of the air-permeable tape 2 for use. With the cover 14 tightly closing the opening 11 after the desired length of tape 2 has been cut off, the remaining tape 2 in the cylindrical body 1 is protected from contamination by external dust and is therefore safely for use the next time.

Figure 5:
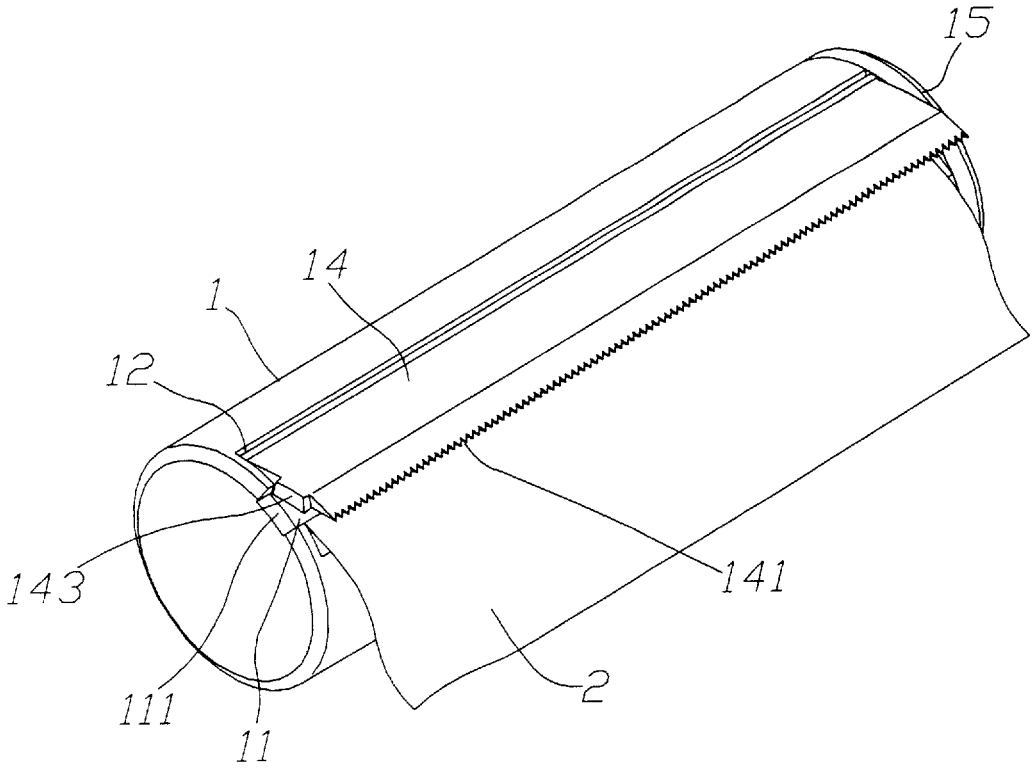
FIG. 5 is an assembled perspective view of a movable air-permeable-tape dispenser according to another embodiment of the present invention.

The cylindrical body 1 is not necessarily limited to a specific length. FIG. 5 shows another embodiment of the present invention that includes a cylindrical body 1 having an axially increased length. Thus, the present invention is adapted to contain and dispense air-permeable tapes of various width or other tapes of different materials.

With the movable air-permeable-tape dispenser of the present invention that has a cylindrical body and a pivotally turnable tooth-edged cover, the air-permeable tape can be dispensed for use in an easier and more sanitary manner.

What is claimed is:

1. A moveable air-permeable-tape dispenser, comprising:

a hollow cylindrical body, on a circumferential surface of which there is provided an axially extended long opening, a slide channel in parallel with and adjacent to a first longitudinal edge of said long opening, and a stepped portion in parallel with and adjacent to a second longitudinal edge of said long opening;

a cover for removably closing said long opening on said cylindrical body, said cover being provided at a front edge corresponding to said second longitudinal edge of said long opening with a row of continuous teeth and at a ear edge corresponding to said first longitudinal edge of said long opening with a shaft, said shaft being diametrically slightly smaller than said slide channel on said cylindrical body to be slid into and fitted in said slide channel, so that said cover pivots about said slide channel relative to said long opening between a lifted position, in which said long opening is opened and an end-of-beginning of a roll of air-permeable tape disposed in said cylindrical body is pulled outwards via said long opening, and a closed position, in which said long opening is closed and the roll of air-permeable tape having outwardly pulled by a desired length is cut off with said teeth provided along the front edge of said cover; and wherein said cylindrical body is provided at a joint of said long opening and an end surface of said cylindrical body with a recess, which has a circumferential length smaller than a distance between said first and second longitudinal edges of said long opening, and said cover being formed at a transverse end corresponding to said recess with an axial protrusion, which is fitly located in said recess when said cover is turned to said closed position.

2. The movable air-permeable-tape dispenser as claimed in claim 1, wherein said cover has a curvature the same as that of said cylindrical body to fitly close said long opening for said cylindrical body to have an integral appearance.

* * * * *